United States Patent [19]

Huber et al.

[11] Patent Number: 4,991,775

[45] Date of Patent: Feb. 12, 1991

[54] QUICK CONNECT FOUNTAIN

[76] Inventors: John J. Huber, 1614 S. Magnolia, Broken Arrow, Okla. 74012; Alvin J. Huber, 5738 E. 61st Pl., Tulsa, Okla. 74136

[21] Appl. No.: 389,951

[22] Filed: Aug. 7, 1989

[51] Int. Cl.[5] ..... B05B 1/16

[52] U.S. Cl. ..... 239/25; 239/229; 239/579; 251/4; 251/340; 251/901

[58] Field of Search ..... 239/25, 29, 30, 24, 239/579, 229; 251/4, 340, 342, 901

[56] References Cited

U.S. PATENT DOCUMENTS

| | | | |
|---|---|---|---|
| 3,030,029 | 4/1962 | Slater, Jr. | 239/25 |
| 3,079,088 | 2/1963 | Hermann et al. | 239/25 |
| 3,329,390 | 7/1967 | Hulsey | 251/4 |
| 3,335,957 | 8/1967 | Jacobson | 239/25 |
| 3,512,711 | 5/1970 | Abbott | 239/25 |
| 4,523,737 | 6/1985 | Wentworth | 251/4 |

*Primary Examiner*—Andres Kashnikow
*Assistant Examiner*—William Grant
*Attorney, Agent, or Firm*—Head & Johnson

[57] ABSTRACT

A drinking fountain attachment for a faucet, such as a kitchen or bathroom faucet, the attachment having a tubular body portion threaded at the upper end for attachment to a downwardly extending faucet and having an orifice opening in the tubular side wall, a spigot element fixed to the exterior of the tubular body communicating with the orifice, providing means for discharging water therefrom in an upward direction to provide a fountain drinking stream. A tubular control member is rotatably supported to the tubular body lower end. A tubular elastomeric member is received within the body and control member and secured at each end in tension whereby the control member is retained in rotatable axial alignment with the body member, the elastomeric member serving to restrict flow of water through the tubular body and control member when the control member is rotated to thereby direct water out the orifice and the spigot to produce a drinking fountain.

5 Claims, 2 Drawing Sheets

Fig. 1
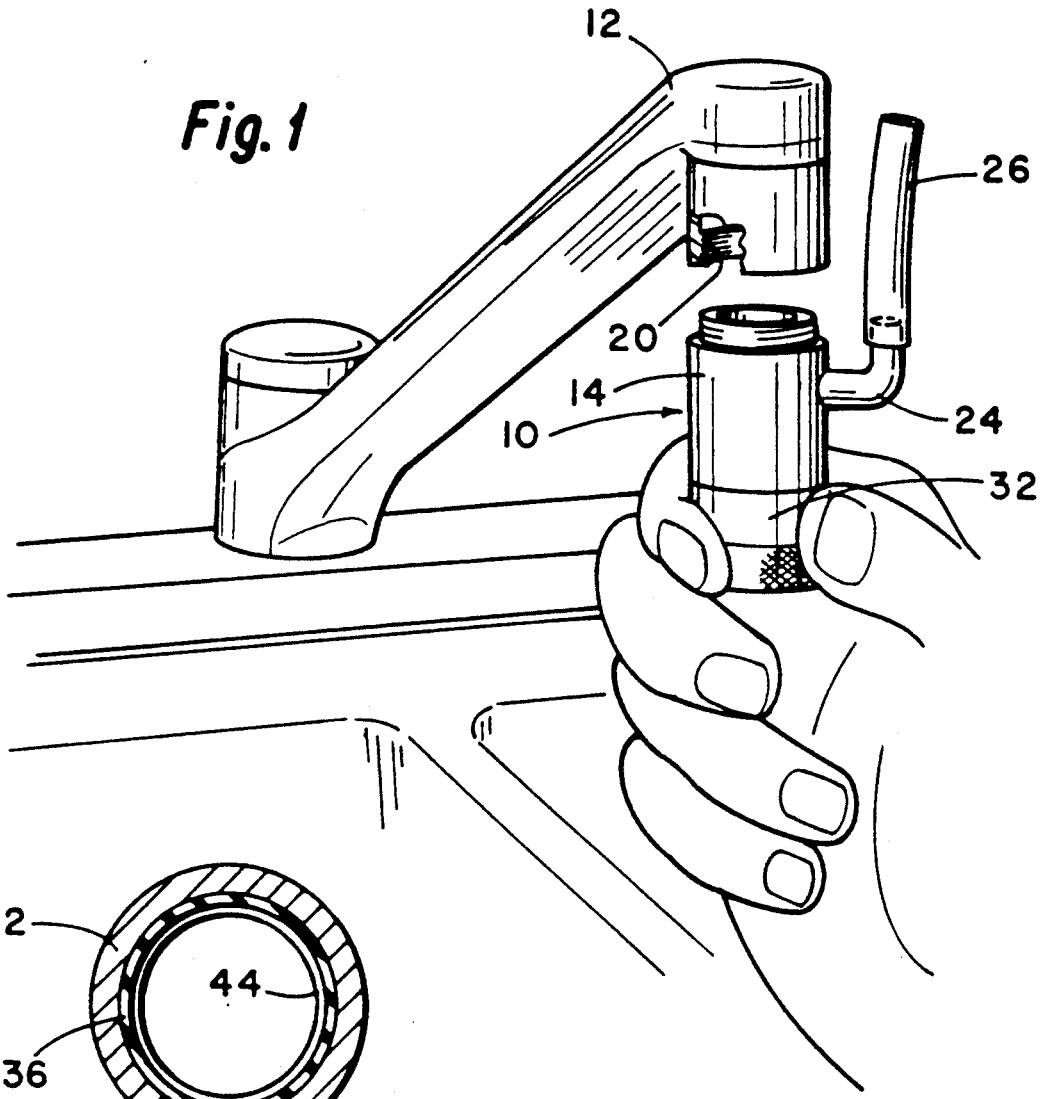
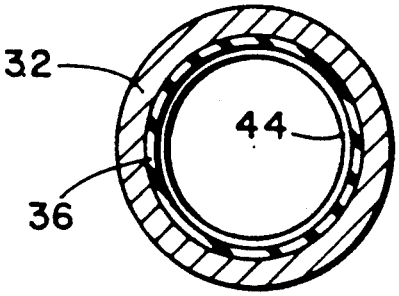
Fig. 4
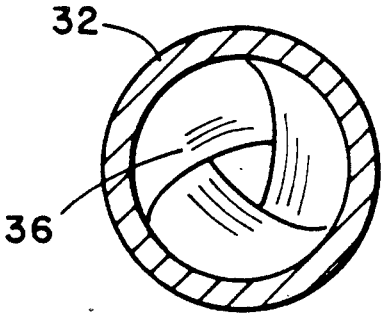
Fig. 5
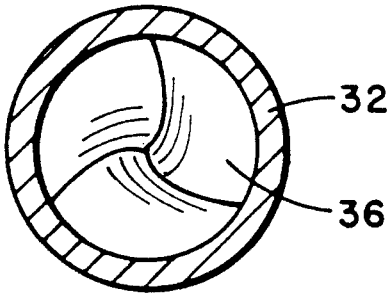
Fig. 6

QUICK CONNECT FOUNTAIN

SUMMARY OF THE INVENTION

In the United States today and most industrialized nations of the world, kitchen sinks and lavatories are provided with faucets by which water is available for cooking, washing hands, shaving and a multitude of other daily uses for which water is needed. The downward discharge of water from a faucet serves most needs for water except for drinking purposes. In order to obtain water for drinking, for rinsing the mouth while brushing the teeth, and so forth, the usual practice is to keep a glass conveniently located.

The present disclosure is directed towards an inexpensive attachment for fitting to a faucet to provide a drinking fountain effect when needed and to thereby make readily available water for drinking, rinsing the mouth and so forth. Others have suggested various devices for providing drinking fountains from a faucet, and for reference to other concepts relating to this subject matter see U.S. Pat. Nos.: 3,030,029; 2,171,471; 2,579,769; 3,062,452; 1,105,547; 3,208,671; and 3,079,088.

These existing disclosures provide devices which work satisfactorily except most are relatively complicated or inconvenient to use or require substantial discharge of water through the faucet in order to obtain a relatively small amount for fountain purposes.

The present device provides an inexpensive, effective and easy to use attachment for a downwardly extending faucet to provide a drinking fountain which has advantages over the existing devices. The drinking fountain attachment of this disclosure includes a tubular body portion having an upper end and a lower end. The upper end includes means for attachment to the downward extending portion of a faucet. Most faucets in use today in the United States and most other industrialized nations have a threaded opening at the lower end. Therefore, the tubular body portion of the drinking fountain attachment is provided with a threaded upper end so that it is readily threaded into the downwardly extending portion of an existing faucet.

The tubular wall of the body portion has an orifice therein with a tubular spigot element attached to it and in communication with the orifice. The spigot element is directed upwardly so that when water flows through the orifice into the tubular spigot element a fountain drinking stream is provided. In a preferred arrangement, the upper end of the tubular spigot element is equipped with an elastomeric member. This latter element is for safety purposes since the use of such elastomeric elements such as a short length of natural or synthetic rubber tube, protects the user against inadvertently hitting his mouth or teeth against the tubular spigot element when the user bends over the faucet to make use of the fountain drinking stream.

A rotary tubular control member, preferably of external diameter essentially that of the tubular body, is rotatably attached to the lower end of the tubular body. The control member is preferably knurled or otherwise provided with a friction imparting external surface so that it can be easily manually rotated.

Received within the aligned tubular body and tubular control member is a short length elastomeric tube. The upper end of the elastomeric tube is affixed to the interior of the tubular body and the lower end is affixed circumferentially to the internal surface of the tubular control member. In a preferred arrangement, the elastomeric control member is under tension which thereby urges the control member in the upward direction towards the tubular body portion and serves to retain the control member in rotatable engagement with the tubular body portion.

To use the drinking fountain attachment, water is first turned on to flow through the faucet. With the control member in its relaxed, normal condition the water freely flows unobstructedly through the tubular body and control member by passing interiorly of the elastomeric tube. Under these conditions, there is no significant pressure differential which would tend to force water through the tubular spigot element so that the faucet is, therefore, used in its normal way as if the drinking fountain attachment was not in place. However, to obtain the flow of water out of the tubular spigot element the user merely rotates the control member. This action twists the elastomeric tube. The more the control element is rotated, the more the tube is twisted and such twisting closes off the interior of the tube and, therefore, restricts the flow of water through the tube. This restriction causes a back pressure forcing water through the orifice, through the tubular spigot element and through the elastomeric spigot member providing a fountain drinking stream.

The height of the stream is easily controlled by the user by the amount of rotation of the control member and by the quantity and the pressure of the water passing through the faucet. The orifice member is preferably selected such that when the faucet is opened to the maximum, and the control member is completely shut-off the discharge of water through the spigot element to produce a fountain drinking stream is insufficient to cause the stream to exceed a limited volume and to thereby restrain the stream to the confines of the sink or lavatory.

A better understanding of the invention will be had by reference to the following description and claims, taken in conjunction with the attached drawings.

DESCRIPTION OF THE DRAWINGS

FIG. 1 is an isometic elevational view showing a faucet such as extends typically over a sink or lavatory. The drinking fountain attachment of this disclosure can be attached to the faucet by threading into the faucet. The hand of a user is shown in the position for controlling the discharge of the fountain drinking stream from the attachment.

FIG. 4 is a cross-sectional view of FIG. 3 with the control member in the relaxed or non-operated position so that water freely and unobstructedly flows through the drinking fountain attachment.

FIG. 5 is a cross-sectional view as in FIG. 4 but showing the control member having been rotated to twist the elastomeric tube and restrict the cross-sectional area of water flow through the attachment to thereby cause a back pressure to force water through the tubular spigot to generate a fountain drinking stream.

FIG. 6 is a cross-sectional view as in FIGS. 4 and 5 but showing the control member having been rotated further, twisting the elastomeric tube to the point where the flow through the tubular body is substantially obstructed to provide maximum flow through the spigot element.

DESCRIPTION OF THE PREFERRED EMBODIMENT

Figure 3:
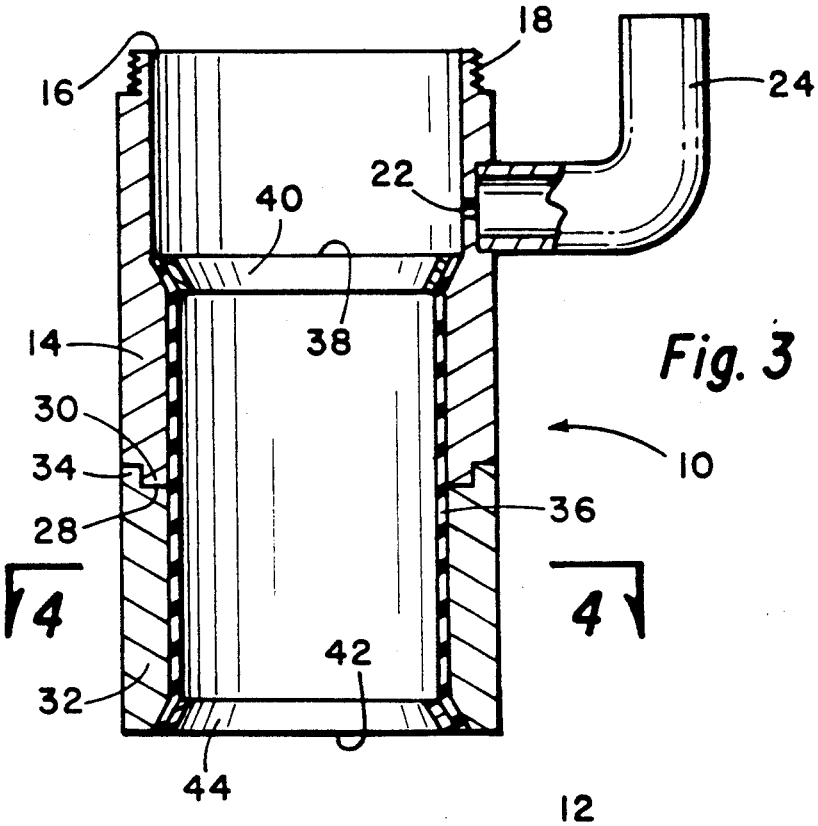
FIG. 3 is a cross-sectional view of the drinking fountain attachment of FIG. 2 with the tubular spigot element partially shown.

Referring to the drawings and first to FIG. 1, the drinking fountain attachment of this invention is indicated generally by the numeral 10. The attachment is shown below and in position for being secured to a typical faucet of the type utilized in a home such as over a lavatory or sink. The disclosure will be described as it is particularly applicable to the attachment of a faucet of the type used indoors, however, as will be understood from the description herein, the principles of the drinking fountain attachment can be applied to any source of flowing water under pressure and therefore the drinking fountain attachment could be utilized such as in conjunction with a faucet of the type found outdoors, in garden areas or the like. The method of affixing the drinking fountain attachment to an outdoor type faucet would be different but the principles of the operation of the drinking fountain attachment would be the same.

Figure 2:
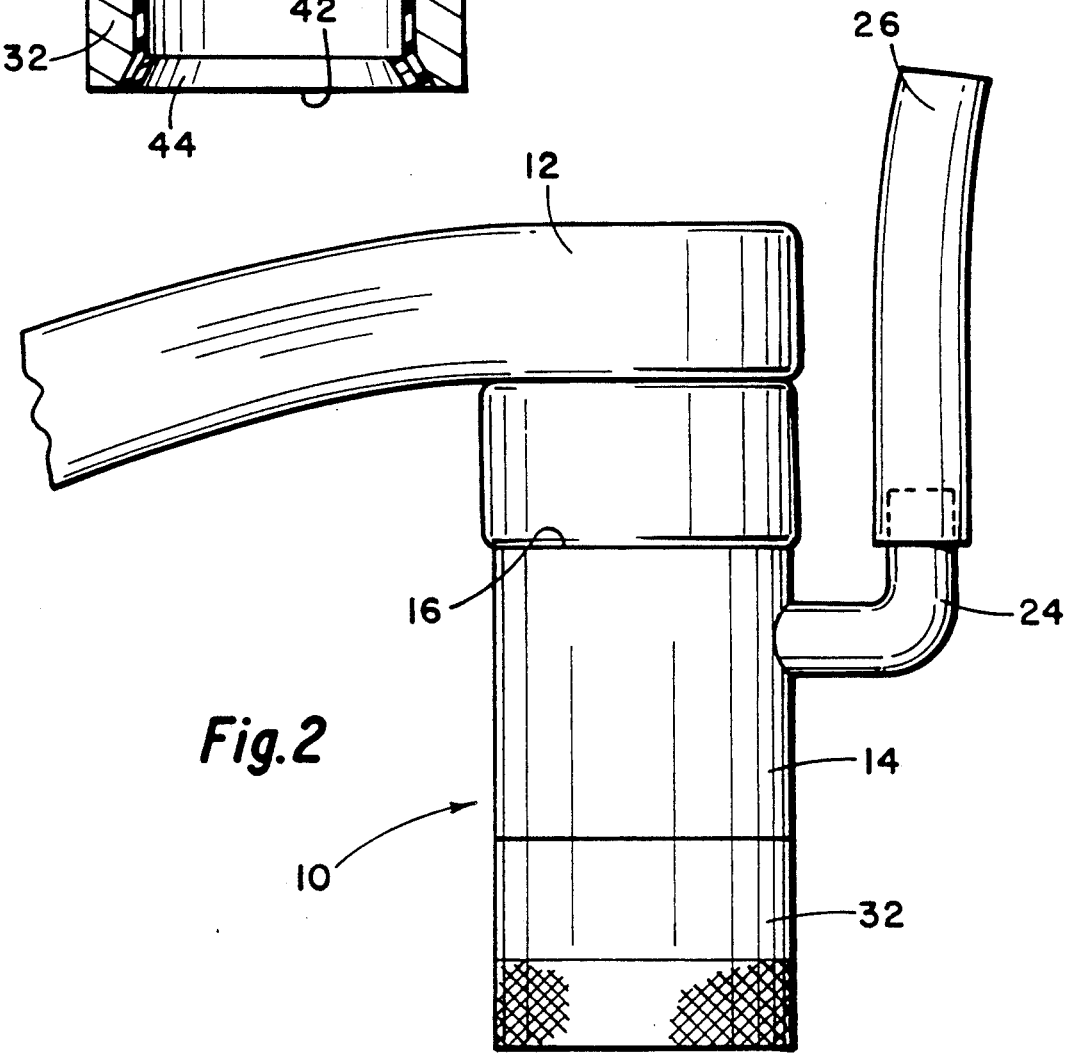
FIG. 2 is an enlarged external view of the drinking fountain attachment of this disclosure attached to a faucet.

FIGS. 2 and 3 show more details of the drinking fountain attachment 10. A tubular body portion 14 has an upper end 16 provided with external threads 18. The external threads 18 are adaptable to receive internal threads 20 which typically exist in most domestic indoor faucets 12 as shown in FIG. 1. Thus, the drinking fountain attachment can be quickly and expeditiously attached to a faucet 12 simply by threading the upper end 16 into the internally threaded downwardly extending portion of a typical faucet.

Formed in the tubular wall of the body portion, adjacent the upper end 16 thereof is a flow control orifice 22. Attached to the exterior of the body portion 14 and communicating with the orifice 22 is a spigot element 24. This element is a short length tubular member secured to the tubular body portion, and preferably is, as shown in FIG. 2, bent upwardly at its outer end so that water flowing therethrough is directed upwardly to provide a fountain effect. For safety purposes a short length soft flexible tube 26, which may be made such as of natural or synthetic rubber, extends over the outer end of the tubular spigot element 24. In this manner, water directed in a fountain drinking stream flows through the orifice 22, through the spigot element 24, and through the flexible tube so that a user when bending down to drink from the fountain is protected against inadvertently hitting his mouth or teeth against a hard metal object.

The lower end 28 of the tubular body member 14 is preferably provided with a reduced external diameter integral flange portion 30.

Received on the lower end 28 is a tubular control member 32, which has at the upper end thereof an integral reduced internal diameter flange portion 34. The function of integral flange portions 30 and 34 are to retain the tubular control member 32 in rotational axial alignment with the lower end of the tubular body portion 14.

Secured to the interior of the lower portion of the tubular body portion 14 and to the interior of the control member 32 is an elastomeric tube 36. Tube 36 is of an external diameter to substantially conform to the internal diameters of the body 14 and control member 32. The upper end 38 of the tube is secured to the interior of the body portion 14 such as by means of a retention ring 40. In like manner, the lower end 42 of tube 36 is secured to the interior lower end of the control member 32 such as by means of a retention ring 44. Thus, the elastomeric tube forms a lining of the interior of the lower portion of body 14 and the full length of control member 32.

The control member 32 and body 14 are retained in rotatable axial alignment. One means of accomplishing this retention is by the employment of an elastomeric tube which is under slight tension. In this way the tube resiliently retains the control member 32 in rotational alignment with the body 16 and without requiring any additional mechanical retention devices.

With the drinking fountain attachment 10 in place as shown in FIG. 2, faucet 12 can be used in the normal manner. That is, when water is caused to flow through the faucet, it flows unobstructedly through the attachment and since the internal diameter of all portions of the drinking fountain attachment is substantially that of the normal internal diameter of the fountain, insignificant resistance to the water flow is caused. Since the resistance is insignificant, very little pressure drop occurs below the orifice 22 and so in normal use a pressure differential does not exist to cause a significant water flow through orifice 22. Therefore, the existence of the drinking fountain attachment 10 does not change in any way the use of the normal faucet 12.

When a user desires to drink water from the faucet, the user merely rotates the control member 32 a fraction of a turn with his fingers in position as shown in FIG. 1. FIG. 4 shows, in cross-section, the control member and elastomeric member and shows an unobstructed flow opening through the drinking fountain attachment. FIG. 5 shows a cross-sectional view when the control member 32 is rotated a fraction of a revolution. The twisting of the elastomeric member 36 causes a reduction in the cross-sectional area of the flow path through the drinking fountain attachment, generating a back pressure which is applied to the orifice 22. When sufficient back pressure is created, water is forced out the spigot element 24 and flexible tube 26 to provide a drinking fountain stream. If necessary the passageway through the elastomeric tube can be substantially closed as shown in FIG. 6 so that the force of water pressure is applied from the faucet to orifice 22 to produce a drinking fountain stream.

Thus, it can be seen that the user can easily control the quantity of water from the spigot 24. The size of orifice 22 will normally be selected such that with a high volume of water flow through faucet 12 and with the elastomeric member 36 twisted to substantially close, that nevertheless the total flow rate through the spigot will not be such as to discharge a stream which would extend beyond the confines of the sink or lavatory of which the faucet 12 exists.

Thus, the drinking fountain attachment provides an inexpensive highly effective, easily attached apparatus for converting a typical sink or lavatory faucet to provide a drinking fountain without interfering with the normal use of the faucet. The drinking fountain attachment is readily controllable by the user to provide the desired volume of water flow through the spigot element which is substantially independent of the volume normally flowing through the faucet—that is, if the faucet is open to provide a generally small flow rate, the user can substantially close the lower end of the drinking fountain attachment to force the total water pressure available to produce flow through the orifice 22 or if a substantial volume of water is flowing through the faucet 12 then the user can only slightly restrict the flow of water through the attachment to produce the desired quantity of flow through the spigot element.

Flexible tubular element 36 provides a self-regulating effect, that is, with high water prssure and a high water flow rate the flexible member will resist closure whereas with lower water pressure and a correspondingly lower flow rate, the tubular element will be easier to close. Thus, the resistance to closure of the tubular element will be tactically sensed by the use so the user will inherently quickly learn the required amount of rotation of element 32 to produce the desired drinking fountain flow rate.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A drinking fountain attachment, for a faucet having a downwardly extending open end portion, comprising:

a tubular body portion having a tubular sidewall and an upper and a lower end and having means for the attachment of the upper end to the downwardly extending portion of the faucet, the body portion having an orifice in the tubular sidewall;

a tubular spigot element affixed at one end to said tubular body portion in communication with said orifice, the spigot element having means for discharge of water therefrom in an upward direction to provide a fountain drinking stream;

a tubular control member rotatably and concentrically affixed to said tubular body portion lower end; and the tubular control member having a tubular elastomeric member therein, the tubular elastomeric member having an upper end affixed circumferentially to the interior of said tubular body portion and a lower end affixed circumferentially to the interior of said tubular control member whereby the rotation of said control member causes said tubular elastomeric member to twist, reducing the internal cross-sectional area thereof to thereby restrict the flow of water therethrough.

2. A drinking fountain attachment according to claim 1 wherein the lower end of said body portion and the upper end of said control member are rotatably concentrically supported and wherein said tubular elastomeric member is under tension and thereby said control member in rotational concentricity with said body portion.

3. A drinking fountain according to claim 1 including a first circumferential retaining ring means affixing said tubular elastomeric member upper end to the interior of said tubular body portion and a second circumferential retaining ring means affixing said tubular elastomeric member lower end to the interior of said tubular control member.

4. A drinking fountain according to claim 1 wherein said tubular spigot element has an inner end and an outer end, the inner end being affixed to said tubular body portion and in which the portion adjacent said outer end is inclined upwardly, and including:

a short length small diameter tubular elastomeric spigot member secured in fluid communication with said spigot element outer upwardly inclined end portion whereby said fountain drinking stream emanates from said elastomeric spigot member.

5. A drinking fountain according to claim 1 wherein said tubular body portion and said tubular control member are of substantially uniform external diameter.

* * * * *